US008339347B2

(12) United States Patent
Bae et al.

(10) Patent No.: US 8,339,347 B2
(45) Date of Patent: Dec. 25, 2012

(54) LIQUID CRYSTAL DISPLAY AND METHOD OF OPERATING THE SAME

(75) Inventors: Hyeon-Seok Bae, Asan-si (KR); Sang-Chul Lee, Yongin-si (KR); Kwang-Youl Lee, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 946 days.

(21) Appl. No.: 12/409,681

(22) Filed: Mar. 24, 2009

(65) Prior Publication Data

US 2010/0033415 A1 Feb. 11, 2010

(30) Foreign Application Priority Data

Aug. 6, 2008 (KR) ..... 10-2008-0077044

(51) Int. Cl.
*G09G 3/36* (2006.01)

(52) U.S. Cl. ..... 345/94; 345/211

(58) Field of Classification Search ..... 345/87–104, 345/211

See application file for complete search history.

(56) References Cited

U.S. PATENT DOCUMENTS 7,911,217 B2 * 3/2011 Nam ..... 324/760.01
2008/0036715 A1 * 2/2008 Lee et al. ..... 345/87

FOREIGN PATENT DOCUMENTS

| | | | |
|---|---|---|---|
| JP | 10-003953 | A | 1/1998 |
| JP | 2006-351527 | A | 12/2006 |
| JP | 2006-351529 | A | 12/2006 |
| JP | 2007-048715 | A | 2/2007 |

* cited by examiner

*Primary Examiner* — Jimmy H Nguyen
(74) *Attorney, Agent, or Firm* — Cantor Colburn LLP

(57) ABSTRACT

A liquid crystal display includes; a liquid crystal panel, and a DC-DC converter which receives an input voltage to generate an analog drive voltage and a gate-on voltage used to operate the liquid crystal panel, wherein the DC-DC converter includes a pulse width modulation circuit which modulates a pulse width of the analog drive voltage and the gate-on voltage, a boost converter which boosts the input voltage to output the analog drive voltage, and a charge pump which boosts one of the input voltage and the analog drive voltage to output the gate-on voltage, wherein when a high voltage stress test is performed, the DC-DC converter outputs the analog drive voltage boosted to a voltage level higher than a voltage level of the analog drive voltage during a normal operation, and outputs the gate-on voltage having a voltage level substantially equal to a voltage level of the gate-on voltage during the normal operation.

21 Claims, 5 Drawing Sheets

Fig. 3

| Voltage | HVS off | HVS on |
|---|---|---|
| AVDD | 14.6V | 16.4V |
| Von | 27V | 27V |

LIQUID CRYSTAL DISPLAY AND METHOD OF OPERATING THE SAME

This application claims priority to Korean Patent Application No. 2008-77044, filed on Aug. 6, 2008, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display ("LCD") and a method of operating the same.

2. Description of the Related Art

Display apparatus, as used in a monitor of a computer, a television set, a mobile display device, etc., come in various types including a cathode ray tube ("CRT"), a field emission device ("FED") and a liquid crystal display ("LCD"). Since the LCD is a non-emissive display apparatus, the LCD requires an additional light source to emit light and provide that light to the LCD.

The LCD includes a backlight unit ("BLU"), a driving circuit unit and a liquid crystal panel. The BLU provides light to the liquid crystal panel and the driving circuit unit operates the liquid crystal panel. The liquid crystal panel includes liquid crystal cells arranged in the form of a matrix. A light transmittance of each liquid crystal cell may be changed according to a voltage charged in the liquid crystal cell. That is, the liquid crystal display controls the light transmittance of the liquid crystal cell through the driving circuit unit, and displays images by providing light from the BLU to the liquid crystal cell.

After manufacturing the LCD, it is subject to an aging process in order to perform quality control. The aging process is performed to test characteristics and reliability of the LCD by placing it in age testing equipment and varying temperature and humidity in the testing equipment. In addition, the performance of the LCD is stabilized through the aging process. The aging process may be applied to each LCD, or may be applied to one or more LCDs out of a batch of LCDs in order to ensure quality control of the batch.

The aging process includes a high voltage stress ("HVS") test. The high voltage stress test is performed by operating the LCD using driving voltages having a higher voltage level than those of normal operational driving voltages (for example, an analog drive voltage, and gate on/off voltages) that are used to drive the LCD during normal operation. The high voltage stress test improves a defective detection rate and reduces a total duration of the aging process.

BRIEF SUMMARY OF THE INVENTION

An exemplary embodiment of the present invention provides a liquid crystal display ("LCD") capable of maintaining an analog drive voltage at a level higher than the analog drive voltage in a normal operation during a high voltage stress test, and a gate-on voltage at substantially a same level as the gate-on voltage in the normal operation.

Another exemplary embodiment of the present invention provides a method of operating the LCD.

In an exemplary embodiment of the present invention, a LCD includes; a liquid crystal panel, and a DC-DC converter which receives an input voltage to generate an analog drive voltage and a gate-on voltage used to operate the liquid crystal panel, wherein the DC-DC converter includes; a pulse width modulation circuit which modulates a pulse width of the analog drive voltage and the gate-on voltage, a boost converter which boosts the input voltage to output the analog drive voltage, and a charge pump which boosts one of the input voltage and the analog drive voltage to output the gate-on voltage, and wherein when a high voltage stress test is executed, the analog drive voltage is boosted to a voltage level higher than a voltage level of the analog drive voltage during a normal operation, and outputs the gate-on voltage having a voltage level substantially equal to a voltage level of the gate-on voltage during the normal operation.

In one exemplary embodiment, the liquid crystal panel includes an amorphous silicon gate disposed on the liquid crystal panel.

In one exemplary embodiment, when the normal operation is performed, the charge pump boosts the analog drive voltage to output the gate on voltage.

In one exemplary embodiment, when the high voltage stress test is performed, the charge pump boosts the input voltage, which has a lower voltage level than the analog drive voltage, to output the gate on voltage.

According to another exemplary embodiment, the DC-DC converter further includes a regulator which outputs a second analog drive voltage having a preset voltage level during the high voltage stress test. In one exemplary embodiment, the second analog drive voltage output by the regulator has a lower voltage level than the analog drive voltage during the high voltage stress test. In one exemplary embodiment, when the high voltage stress test is performed, the charge pump boosts the second analog drive voltage output by the regulator to output the gate on voltage.

According to another exemplary embodiment, the DC-DC converter includes; a pulse width modulation circuit which modulates a pulse width of an analog drive voltage and a gate-on voltage, a boost converter which boosts an input voltage to output the analog drive voltage, and a charge pump which boosts one of the input voltage and the analog drive voltage to output the gate on voltage, wherein when a high voltage stress test is performed, the analog drive voltage is boosted to a voltage level higher than a voltage level of the analog drive voltage during a normal operation, and the gate-on voltage maintains a voltage level substantially equal to a voltage level of the gate-on voltage during the normal operation.

In another exemplary embodiment of the present invention, a method of operating a LCD includes; boosting an input voltage to generate an analog drive voltage, and boosting the analog drive voltage during a normal operation to generate a gate-on voltage, and boosting a voltage having a lower voltage level than the analog drive voltage during a high voltage stress test to generate the gate-on voltage.

In one exemplary embodiment, when the high voltage stress test is performed, an input voltage having a lower voltage level than the analog drive voltage is boosted to generate the gate-on voltage.

In one exemplary embodiment, when the high voltage stress test is performed, the analog drive voltage has a voltage level higher than the analog drive voltage during the normal operation.

In one exemplary embodiment, the LCD includes a liquid crystal panel provided with an amorphous silicon gate.

In one exemplary embodiment, when the high voltage stress test is performed, the analog drive voltage has a voltage level higher than that of the analog drive voltage in the normal operation.

According to the above, when the HVS stress test is performed, the gate-on voltage maintains the voltage level substantially equal to that of the gate-on voltage in the normal operation, and the analog drive voltage is boosted to the voltage level higher than that of the analog drive voltage in the normal operation. Accordingly, the HVS test can be performed without causing display defects, such as a staining effect, resulting from an increase in the gate-on voltage.

BRIEF DESCRIPTION OF THE DRAWINGS

The above and other advantages of the present invention will become readily apparent by reference to the following detailed description when considered in conjunction with the accompanying drawings wherein:

FIG. 3 is a table showing a test result obtained using the exemplary embodiment of a DC-DC converter shown in FIG. 2;

DETAILED DESCRIPTION OF THE INVENTION

Figure 1:
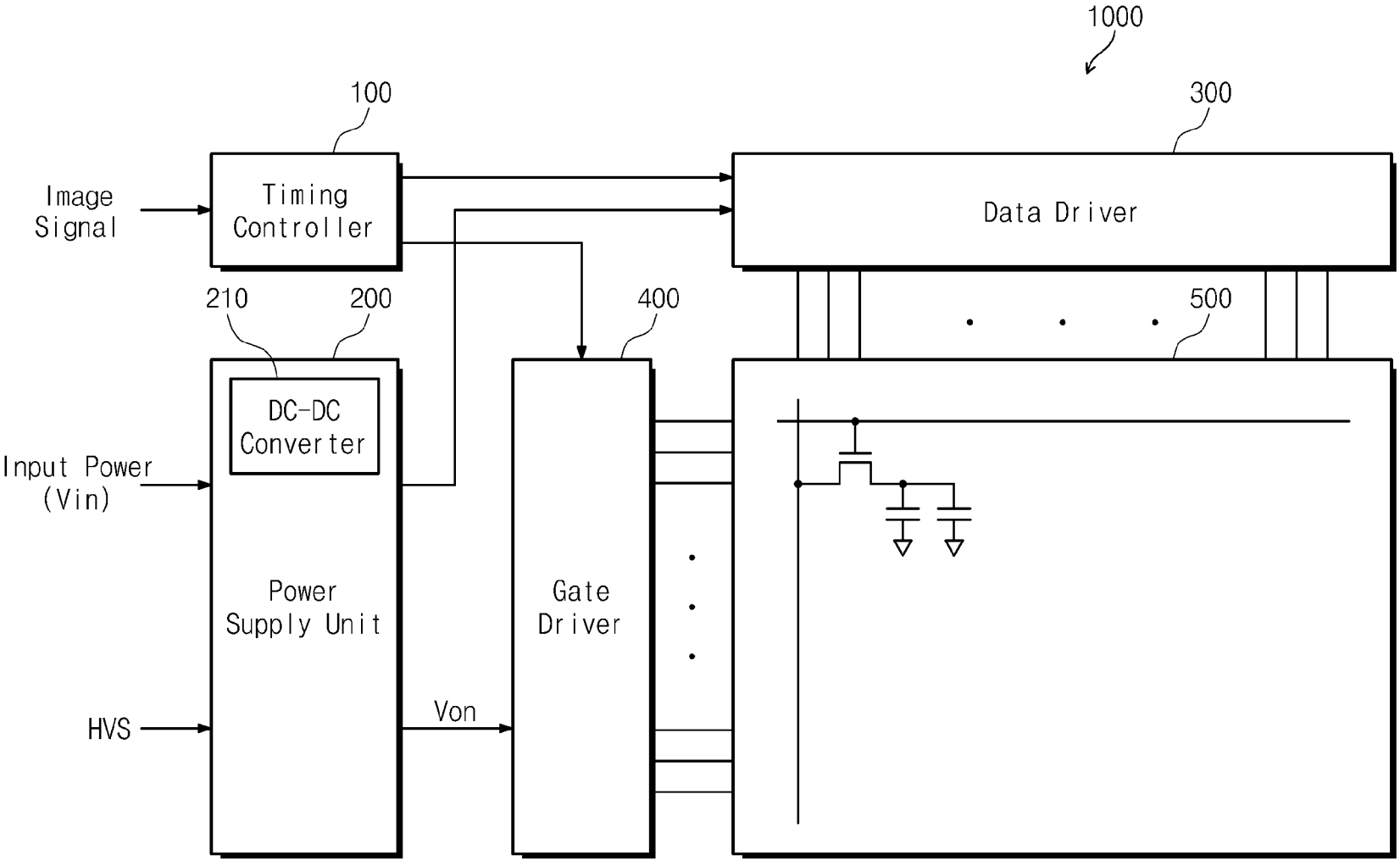
FIG. 1 is a block diagram illustrating an exemplary embodiment of a liquid crystal display ("LCD") according to the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings.

An exemplary embodiment of a liquid crystal display ("LCD") according to the present invention includes a DC-DC converter which boosts an analog drive voltage from a normal operation to a higher voltage level used in a High Voltage Stress ("HVS") test, and maintains a level of a gate on voltage in the HVS test equal to that of a gate on voltage represented in the normal operation. Hereinafter, an exemplary embodiment of the present invention will be explained in detail with reference to the accompanying drawing. FIG. 1 is a block diagram showing an exemplary embodiment of an LCD according to the present invention.

Referring to FIG. 1, a LCD 1000 includes a timing controller 100, a power supply unit 200, a data driver 300, a gate driver 400 and a liquid crystal panel 500.

The timing controller 100 controls the data driver 300 and the gate driver 400 in response to image signals transmitted from the outside. For example, the timing controller 100 receives digital image signals R, G and B from the outside. The timing controller 100 generates a gate control signal in response to the digital image signals R, G and B transmitted from the outside. The gate control signal is transmitted to the gate driver 400. The timing controller 100 generates a data control signal in response to the digital image signals R, G and B. In the present exemplary embodiment, the digital image signals R, G and B and the data control signal are transmitted to the data driver 300. Alternative exemplary embodiments include configurations wherein the digital image signals R, G and B are modified before being sent to the data driver 300.

The power supply unit 200 provides drive power to the data driver 300 and the gate driver 400. For example, the power supply unit 200 receives an input voltage Vin to generate a drive voltage VDD, a gate-on voltage Von, a gate-off voltage Voff, a gamma voltage for use in the data driver 300, etc. The gamma voltage is transmitted to the data driver 300. The gate-on voltage Von and the gate-off voltage Voff are transmitted to the gate driver 400. The drive voltage VDD may be used as an operating power, although alternative exemplary embodiments include configurations wherein the drive voltage VDD may be omitted. Although not shown in FIG. 1, the power supply unit 200 may additionally generate a common voltage Vcom transmitted to the liquid crystal panel 500.

The power supply unit 200 includes a DC-DC converter 210. The DC-DC converter 210 receives the input voltage Vin and generates an analog drive voltage AVDD and the gate-on voltage Von.

The power supply unit 200 may further include electronic components such as a gamma voltage generator and a common voltage generator. In such exemplary embodiments, the gamma voltage generator receives the analog drive voltage AVDD to generate the gamma voltage and the common voltage generator receives the analog drive voltage AVDD to generate the common voltage Vcom.

The power supply unit 200 receives a high voltage stress test signal HVS from the outside. If the high voltage stress test signal HVS is enabled, the power supply unit 200 boosts the analog drive voltage AVDD to a level higher than that of an analog drive voltage in a normal operation and maintains a level of the gate on voltage Von equal to that of a gate-on voltage in normal operation.

The data driver 300 receives power from the power supply unit 200 and operates in response to the data control signal from the timing controller 100. The data driver 300 generates an analog gray scale voltage corresponding to the digital image signals R, G and B transmitted from the timing controller 100 using the gamma voltage transmitted from the power supply unit 200. The data driver 300 provides the analog gray scale voltage to a plurality of data lines whenever the gate-on voltage Von is applied to a gate line of the liquid crystal panel 500.

The gate driver 400 receives power from the power supply unit 200 and operates in response to the gate control signal from the timing controller 100. The gate driver 400 receives the gate-on voltage Von and the gate-off voltage Voff from the power supply unit 200. The gate driver 400 alternately applies the gate-on voltage Von and the gate-off voltage Voff to a plurality of gate lines of the liquid crystal panel 500 in response to the control signal from the timing controller 100.

The liquid crystal panel 500 is connected to the data driver 300 and the gate driver 400 through the plurality of data lines and the plurality of gate lines, respectively. The liquid crystal panel 500 includes a plurality of liquid crystal cells connected to the data lines and the gate lines. For the purpose of convenience, one data line, one gate line and one liquid crystal cell are shown in FIG. 1. In the present exemplary embodiment, the liquid crystal panel 500 includes the liquid crystal cells arranged in the form of a matrix. If the gate-on voltage Von is applied to the gate line, a transistor of the liquid crystal cell is turned on. If the analog gray scale voltage is applied to the date line, a capacitor of the liquid crystal cell is charged with the analog gray scale voltage. If the gate-off voltage is applied to the gate line, the transistor of the liquid crystal cell is turned off. Liquid crystals are operated according to the voltage charged in the liquid crystal cell, so that transmittance of light passing through the liquid crystal can be adjusted. In one exemplary embodiment, the liquid crystal panel 500 may include an amorphous silicon gate ("ASG") configuration.

During the HVS test, if the gate-on voltage Von is boosted to a level higher than that of the gate on voltage during normal operation, a stain defect occurs. Accordingly, when the HVS test is performed, the analog drive voltage AVDD is boosted to a level higher than that of the analog drive voltage AVDD during normal operation, and it is desirable that the gate-on voltage Von maintains substantially the same level as that of the gate-on voltage Von during normal operation.

Conventional liquid crystal driving apparatuses are equipped with a first pulse width modulator for generating the analog drive voltage AVDD and a second pulse width modulator for generating the gate-on voltage Von in order to boost the analog drive voltage AVDD represented in the HVS test to a higher voltage level than that of the analog drive voltage during normal operation, and to maintain the gate-on voltage Von at a level equal to that of the gate on voltage during normal operation.

However, in the exemplary embodiment of the LCD including the liquid crystal panel 500 provided with the ASG configuration, an output current of the gate-on voltage Von is greater than an output current of the gate-on voltage Von of a conventional liquid crystal driving apparatus. Accordingly, the LCD including the liquid crystal panel 500 provided with the ASG configuration generates the analog drive voltage AVDD and the gate-on voltage Von using a pulse width modulation ("PWM") circuit for the analog drive voltage AVDD without using an additional PWM circuit for the gate-on voltage Von.

Since the analog drive voltage AVDD and the gate-on voltage Von are generated through one PWM circuit, if the analog drive voltage AVDD is boosted to the level higher than that of the analog drive voltage during normal operation for the purpose of the HVS test, the gate-on voltage Von is also boosted to a level higher than that of the gate-on voltage during normal operation. Accordingly, in the exemplary embodiment of the LCD including the LCD 500 provided with the amorphous silicon gate, the stain defect may occur during the HVS test.

The present exemplary embodiment of the LCD 1000 according to the present invention generates the analog drive voltage AVDD and the gate-on voltage Von using one PWM circuit. In addition, when the HVS test is performed, the exemplary embodiment of an LCD according to the present invention boosts the analog drive voltage AVDD to the level higher than that of the analog driving voltage during normal operation and yet maintains the level of the gate-on voltage Von substantially equal to that of the gate on voltage during normal operation. Accordingly, even if the LCD 1000 according to the present exemplary embodiment includes the liquid crystal panel 500 provided with the ASG configuration, the HVS test can be performed without the stain defect. Hereinafter, the present exemplary embodiment of an LCD 1000 will be described in detail with reference to FIGS. 2 to 4.

Figure 2:
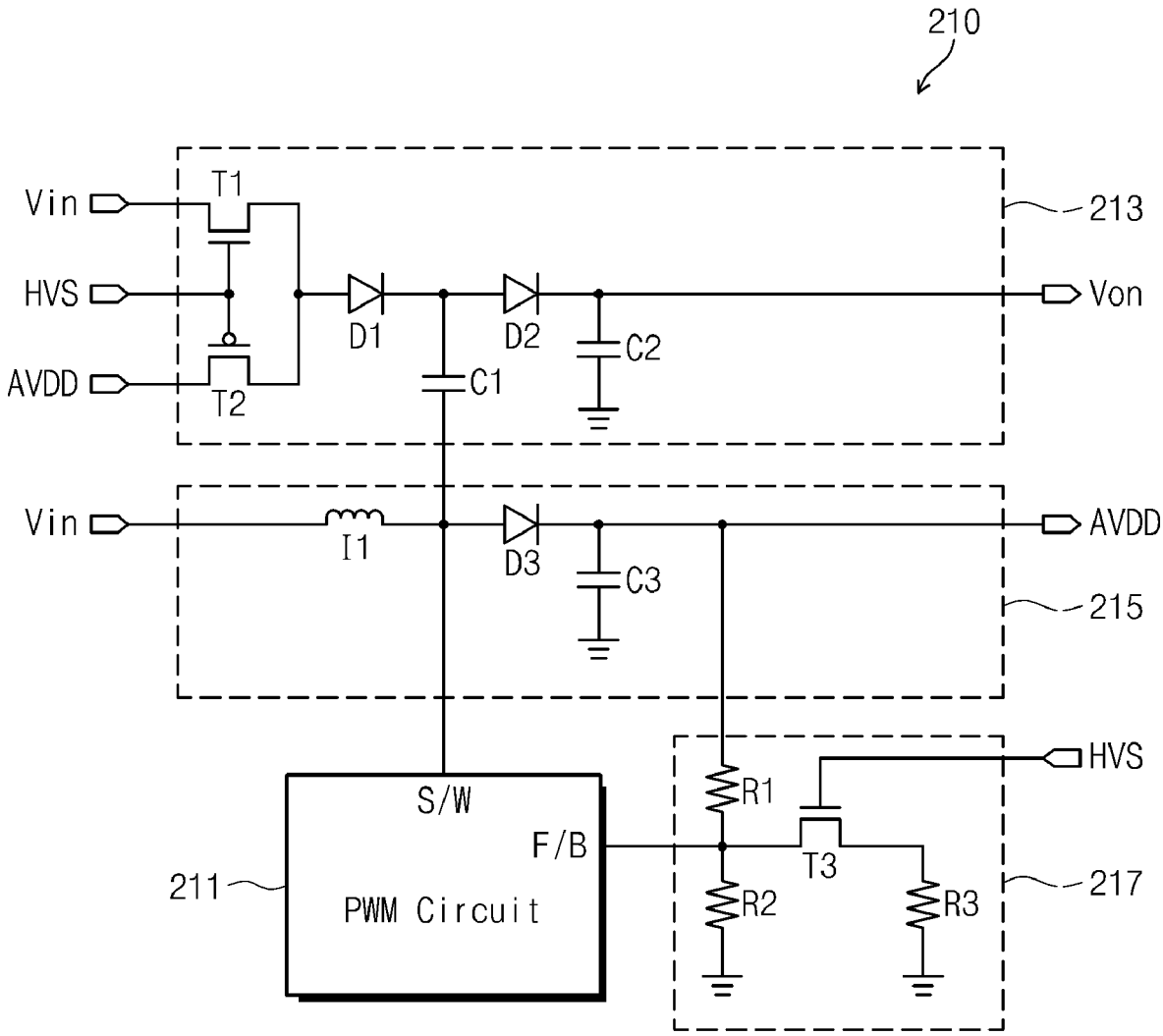
FIG. 2 is an equivalent circuit diagram illustrating an exemplary embodiment of a DC-DC converter of FIG. 1.

FIG. 2 is an equivalent circuit diagram showing an exemplary embodiment of a DC-DC converter according to of FIG. 1.

Referring to FIG. 2, the exemplary embodiment of a DC-DC converter 210 according to the present invention includes a PWM circuit 211, a charge pump 213, a boost converter 215 and a feedback resistor 217.

A switching terminal S/W of the PWM circuit 211 is connected to the boost converter 215, and a feedback terminal F/B of the PWM circuit 211 is connected to the feedback resistor 217. The PWM circuit 211 controls a pulse width of an output pulse according to resistance value of a resistor connected to the feedback terminal F/B. In one exemplary embodiment, when the resistance value of the resistor connected to the feedback terminal F/B of the PWM circuit 211 decreases, the PWM circuit 211 outputs an output pulse having an increased pulse width. For example, the PWM circuit 211 receives the input voltage Vin to output an output pulse having a modulated pulse width.

The charge pump 213 includes diodes D1 and D2, capacitors C1 and C2 and transistors T1 and T2. An input terminal of the diode D1 is connected to the transistors T1 and T2. An output terminal of the diode D1 is connected to an input terminal of the diode D2 and the capacitor C1. The capacitor C1 is connected to the PWM circuit 211. An output terminal of the diode D2 is connected to a ground terminal through the capacitor C2, and is also used as the gate-on voltage Von. The HVS test signal HVS is transmitted to a gate of the transistors T1 and T2. The transistor T1 is connected to the input voltage Vin and the transistor T2 is connected to the analog drive voltage AVDD.

The boost converter 215 includes an inductor I1, a diode D3 and a capacitor C3. An input terminal of the diode D3 is connected to the inductor I1, the charge pump 213 and the PWM circuit 211. An output terminal of the diode D3 is connected to the capacitor C3 and the feedback resistor 217. The output of the diode D3 is also used as the analog drive voltage AVDD. The input voltage Vin is transmitted to the inductor I1. In one exemplary embodiment, the diode D3 includes a schottky diode.

The feedback resistor 217 includes resistors R1, R2 and R3 and a transistor T3. The resistors R1 and R2 are connected to each other in series. The PWM circuit 211 is connected to the transistor T3 between the resistors R1 and R2. The resistor R3 is connected to the resistor R2 in parallel through the transistor T3. The HVS test signal HVS is transmitted to a gate of the transistor T3.

In one exemplary embodiment, the HVS test signal HVS is deactivated during the normal operation; e.g., the HVS test signal HVS is a logic low. In such an exemplary embodiment, the transistors T1 and T3 are turned off, and the transistor T2 is turned on. The PWM circuit 211 modulates the input voltage Vin to output the modulated input voltage. The boost converter 215 boosts the input voltage Vin to generate the analog drive voltage AVDD. The charge pump 213 boosts the analog drive voltage AVDD generated by the boost converter 215 to generate the gate-on voltage Von.

In one exemplary embodiment, the HVS test signal HVS is activated during the HVS test operation; e.g., the HVS test signal HVS is a logic high. In such an exemplary embodiment, the transistors T1 and T3 are turned on, and the transistor T2 is turned off. If the transistor T3 is turned on, the resistor R3 is connected to the R2 in parallel. That is, the resistance value of the resistor connected to the feedback terminal F/B of the PWM circuit 211 decreases. Accordingly, the pulse width of the output pulse generated from the PWM circuit 211 increases, and the analog drive voltage AVDD generated by the boost converter 215 is boosted to the level higher than that of the analog drive voltage during normal operation.

The charge pump 213 boosts the input voltage Vin to output the gate on voltage Von. That is, the charge pump 213 generates the gate-on voltage Von using the input voltage Vin, which is lower than the analog drive voltage AVDD. The analog drive voltage AVDD is boosted to the level higher than that of the analog drive voltage during normal operation. Accordingly, even if the analog drive voltage AVDD is boosted to the level higher than that of the analog drive voltage during normal operation, the gate-on voltage Von does not rise.

In one exemplary embodiment, the output pulse of the PWM circuit 211 is transmitted to the capacitor C1 of the charge pump 213. That is, variation of the output pulse of the PWM circuit 211 may exert an influence on the charge pump 213. In order to prevent the influence caused by variation of the output pulse of the PWM circuit 211 during the HVS test, the charge pump 213 generates the gate-on voltage Von using the input voltage Vin having a voltage level lower than the analog drive voltage AVDD during normal operation.

FIG. 3 is a table showing a test result obtained using the exemplary embodiment of a DC-DC converter shown in FIG. 2.

Referring to FIG. 3, during the normal operation, that is, when the HVS test signal is deactivated, the analog drive voltage AVDD is 14.6V, and the gate-on voltage Von is 27V. During the HVS test, that is, when the HVS test signal HVS is activated, the analog drive voltage AVDD is 16.4 and the gate-on voltage is 27V. According to the present exemplary embodiment of the present invention, when the HVS test is executed, the analog drive voltage AVDD is boosted to the level higher than that of the analog drive voltage AVDD during normal operation, and the gate-on voltage Von maintains the same level as that of the gate on voltage Von during normal operation.

Figure 4:
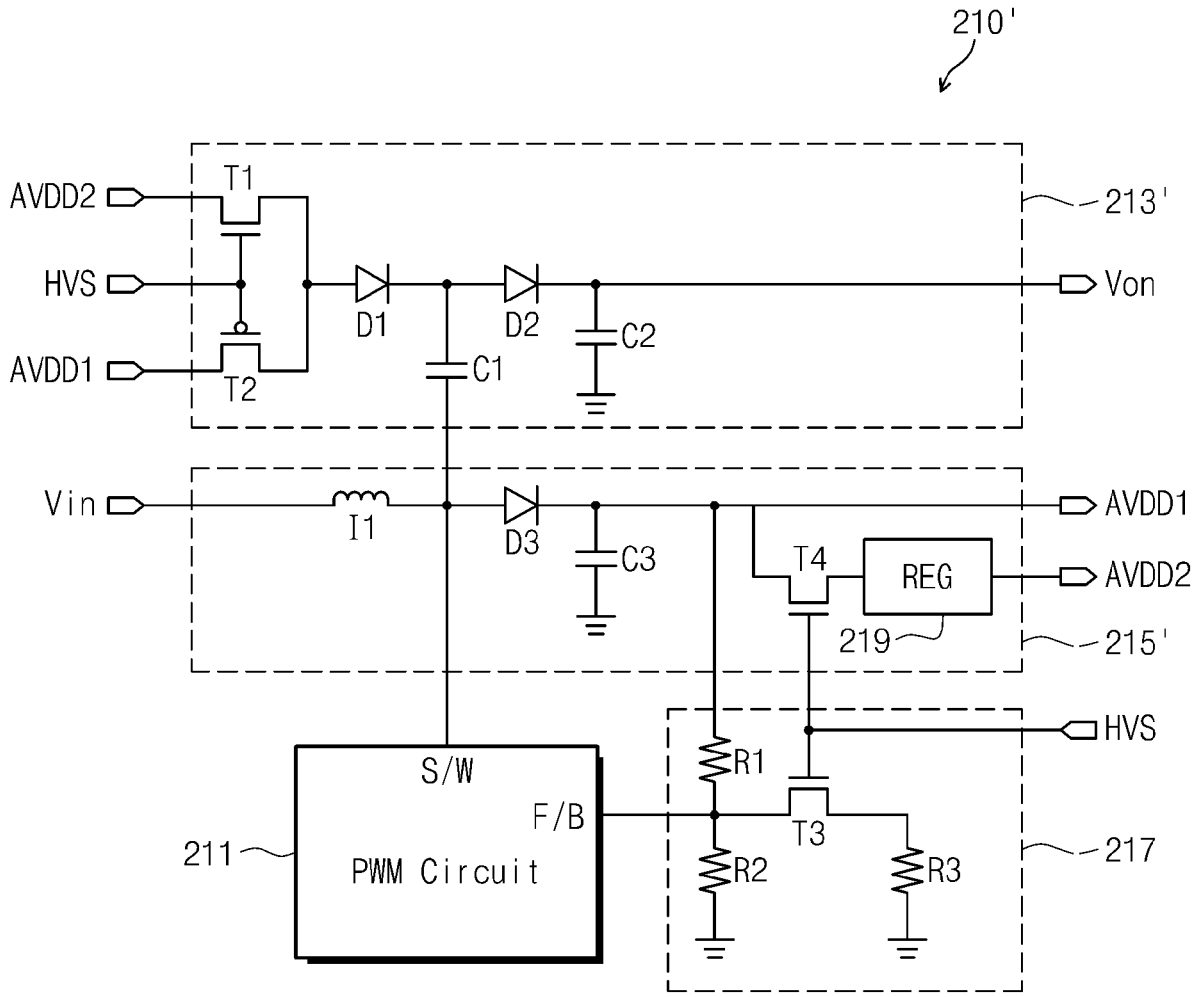
FIG. 4 is an equivalent circuit diagram illustrating another exemplary embodiment of a DC-DC converter of FIG. 1.

FIG. 4 is an equivalent circuit diagram illustrating another exemplary embodiment of the DC-DC converter according to the present invention. Most components except a charge pump 213' and a boost converter 215' of a DC-DC converter 210' shown in FIG. 4 are substantially identical to those of the DC-DC converter 210 shown in FIG. 2. Accordingly, for convenience sake, the description of the same components will be omitted to avoid redundancy.

A boost converter 215' further includes a regulator 219 and a transistor T4 as compared with the exemplary embodiment of a boost converter 215 described above with reference to FIG. 2. The boost converter 215' outputs a first analog drive voltage AVDD1 by boosting the input voltage Vin. The regulator 219 is connected to an output of the diode D3 through the transistor T4. That is, the regulator 219 receives the first analog drive voltage AVDD1 through the transistor T4. The HVS test signal is transmitted to a gate of the transistor T4.

A charge pump 213' has substantially the same structure as the charge pump 213 described with reference to FIG. 2 except for the input voltage input into the charge pump 213'. The transistor T1 of the charge pump 213' receives a second analog drive voltage AVDD2 and the transistor T2 of the charge pump 213' receives the first analog drive voltage AVDD1.

During normal operation, that is, if the HVS test signal HVS is deactivated, the transistors T1, T3 and T4 are turned off and the transistor T2 is turned on. That is, the boost converter 215' generates the first analog drive voltage AVDD1 by boosting the input voltage Vin, and the charge pump 213' generates a gate-on voltage Von by boosting the first analog drive voltage AVDD1.

During the HVS test, that is, if the HVS test signal HVS is activated, the transistors T1, T3 and T4 are turned on, and the transistor T2 is turned off. That is, the boost converter 215' generates the first analog drive voltage AVDD1 boosted to a level higher than that of the first analog drive voltage AVDD1 during normal operation. The regulator 219 of the boost converter 215' generates the second analog drive voltage AVDD2 by rectifying the first analog drive voltage AVDD1 that is boosted to the level higher than that of the analog drive voltage represented in the normal operation. In the present exemplary embodiment, the second analog drive voltage AVDD2 has a voltage level lower than that of the first analog drive voltage AVDD1. For example, the regulator 219 generates the second analog drive voltage AVDD2 of about 14V by rectifying the first analog drive voltage AVDD1 boosted to a level higher than that of the second analog drive voltage AVDD2 during normal operation.

The charge pump 213' generates the gate-on voltage Von by boosting the second analog drive voltage AVDD2. For example, the second analog drive voltage AVDD2 has a voltage level lower than that of the first analog drive voltage AVDD1 during normal operation. Accordingly, the HVS test can be executed while compensating for the variation of the pulse width of the output pulse generated from the PWM circuit 211. That is, the gate-on voltage Von maintains the same level as that of the gate on voltage during normal operation.

Differently from that the first exemplary embodiment of a DC-DC converter 210 shown in FIG. 2, which generates the gate-on voltage by boosting the input voltage Vin, the DC-DC converter 210' according to the present exemplary embodiment shown in FIG. 4 generates the gate-on voltage Von by boosting the second analog drive voltage AVDD2 rectified by the regulator 219. Accordingly, the current exemplary embodiment of a DC-DC converter 210' according to the present invention stably generates the gate-on voltage Von even if the input voltage Vin is unstable.

Figure 5:
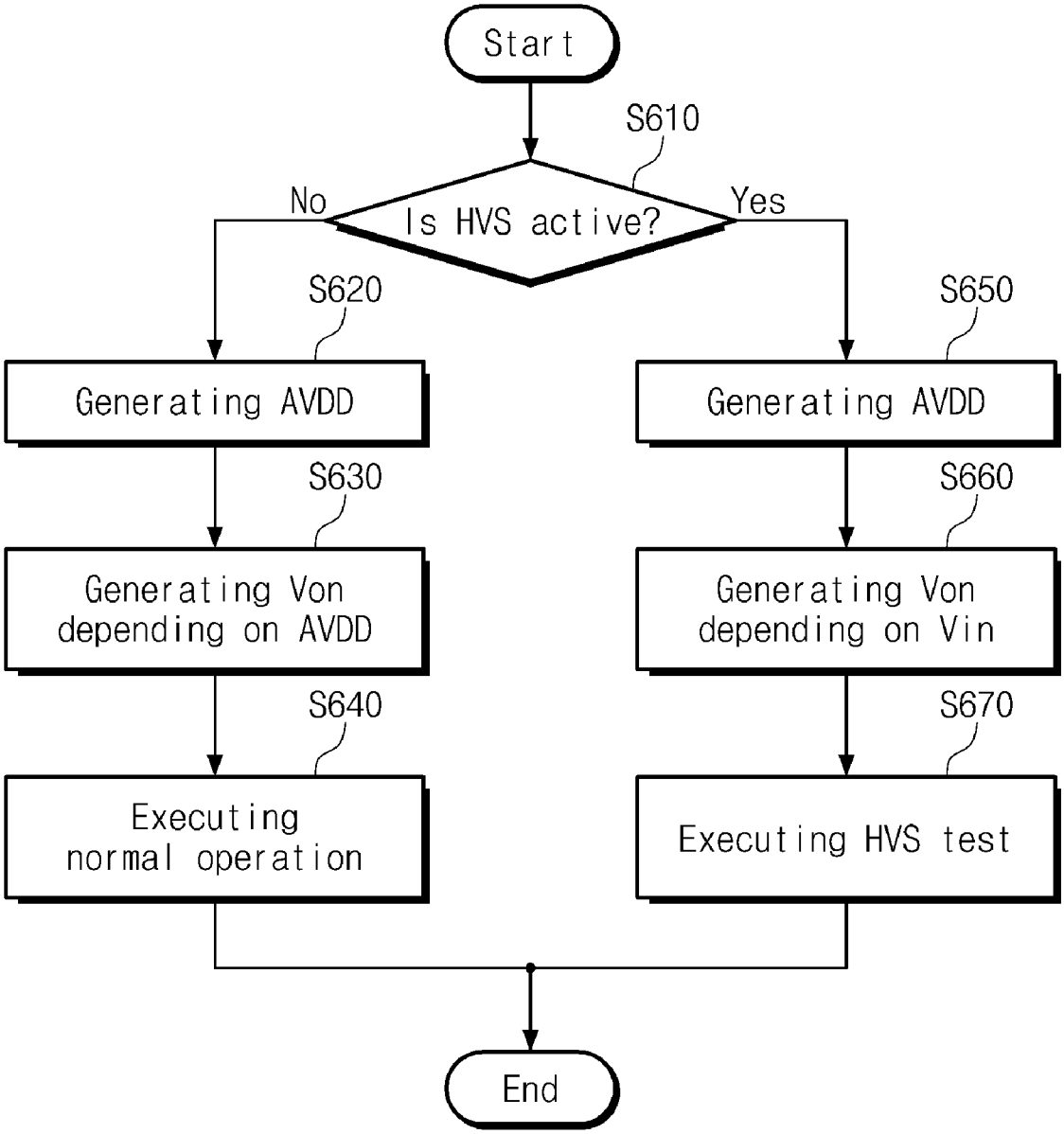
FIG. 5 is a flowchart illustrating an exemplary embodiment of a method of operating the exemplary embodiment of an LCD of FIG. 1.

FIG. 5 is a flowchart illustrating a method of operating the LCD of FIG. 1.

Referring to FIGS. 1, 2, 4 and 5, a subsequent operation is determined depending on the activation state of the HVS test signal HVS (S610). If the HVS test signal HVS is deactivated, the analog drive voltage AVDD is generated (S620). For example, the boost converter 215 shown in FIG. 2 generates the analog drive voltage AVDD by boosting the input voltage Vin. As another example, the boost converter 215' shown in FIG. 4 generates the analog drive voltage AVDD1 by boosting the input voltage Vin.

Then, the gate-on voltage Von is generated based on the analog drive voltage AVDD (S630). For example, the charge pump 213 shown in FIG. 2 generates the gate-on voltage Von by boosting the analog drive voltage AVDD. As another example, the charge pump 213' shown in FIG. 4 generates the gate-on voltage Von by boosting the analog drive voltage AVDD1.

Next, the normal operation is executed (S640). For example, the power supply unit 210 generates the gate-off voltage Voff and then generates the common voltage Vcom and the gamma voltage using the analog drive voltage AVDD, depending upon the exemplary embodiment. The gate-on voltage Von and the gate-off voltage Voff are transmitted to the gate driver 400. The common voltage Vcom is transmitted to the liquid crystal panel 500. The gamma voltage is transmitted to the data driver 300. The timing controller 100 transmits the image signals R, G and B to the data driver 300. The data driver 300 and the gate driver 400 control the liquid crystal panel 500 to display images corresponding to the image signals R, G and B.

If the HVS test signal HVS is activated (S610), the analog drive voltage AVDD is generated (S650). For example, the boost converter 215 shown in FIG. 2 generates the analog drive voltage AVDD by boosting the input voltage Vin. The analog drive voltage AVDD has a voltage level higher than that of the analog drive voltage AVDD during normal operation. As another example, the exemplary embodiment of a boost converter 215' shown in FIG. 4 generates the first analog driver voltage AVDD1 by boosting the input voltage Vin and then generates the second analog drive voltage AVDD2 by rectifying the first analog drive voltage AVDD1. The first analog drive voltage AVDD1 has a voltage level higher than that of the first analog drive voltage AVDD1 during normal operation. The second analog drive voltage AVDD2 has a voltage level lower than that of the first analog drive voltage AVDD1 during normal operation.

Then, the gate-on voltage Von is generated based on the input voltage Vin (S660). For example, the charge pump 213 shown in FIG. 2 generates the gate-on voltage Von by boosting the input voltage Vin. The gate-on voltage Von has substantially the same voltage level as the gate-on voltage during normal operation. As another example, the charge pump 213' shown in FIG. 4 generates the gate-on voltage Von by boosting the second analog drive voltage AVDD2, which in turn has been generated from the input voltage Vin as described above. The gate-on voltage Von has substantially the same level as that of the gate-on voltage Von during normal operation.

Next, the HVS test is executed (S670). The HVS test is executed similarly to step S640 except that the analog drive voltages AVDD have the voltage level higher than that of the analog drive voltage AVDD during normal operation.

As described above, in the exemplary embodiment of an LCD 1000 according to the present invention, when the high voltage stress test is executed, the analog drive voltages AVDD are boosted to the voltage level higher than that of the analog drive voltage during normal operation, and the gate-on voltage Von has substantially the same level as that of the analog drive voltage during normal operation. Accordingly, the high voltage stress test can be executed without causing the stain defect.

Although the exemplary embodiment of an LCD 1000 according to the exemplary invention includes the liquid crystal panel 500 provided with the ASG configuration, the present invention is not limited thereto. Those skilled in the art will be appreciated that the scope and sprit of the present invention can be applied to the LCD 1000 regardless of a configuration of the liquid crystal panel.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A liquid crystal display comprising:

a liquid crystal panel; and a DC-DC converter which receives an input voltage to generate an analog drive voltage and a gate-on voltage used to operate the liquid crystal panel, wherein the DC-DC converter comprises:

a pulse width modulation circuit which modulates a pulse width of the analog drive voltage and the gate-on voltage;

a boost converter which outputs the analog drive voltage by boosting the input voltage; and a charge pump which outputs the gate-on voltage by boosting one of the input voltage and the analog drive voltage, wherein, when a high voltage stress test is performed, the DC-DC converter outputs the analog drive voltage boosted to a voltage level higher than a voltage level of the analog drive voltage during a normal operation, and outputs the gate-on voltage having a voltage level equal to a voltage level of the gate-on voltage during the normal operation.

2. The liquid crystal display of claim 1, further comprising:

a gate driver which receives the gate-on voltage and provides a gate signal to the liquid crystal panel; and a data driver which receives the analog drive voltage and provides a data signal to the liquid crystal panel.

3. The liquid crystal display of claim 2, wherein the gate driver includes an amorphous silicon gate disposed on the liquid crystal panel.

4. The liquid crystal display of claim 1, wherein, when the normal operation is performed, the charge pump boosts the analog drive voltage to output the gate-on voltage.

5. The liquid crystal display of claim 1, wherein, when the high voltage stress test is performed, the charge pump boosts the input voltage, which has a lower voltage level than the analog drive voltage, to output the gate on voltage.

6. The liquid crystal display of claim 1, wherein, the DC-DC converter further comprises a regulator which outputs a second analog drive voltage having a preset voltage level during the high voltage stress test.

7. The liquid crystal display of claim 6, wherein the second analog drive voltage output by the regulator has a lower voltage level than the analog drive voltage during the high voltage stress test.

8. The liquid crystal display of claim 6, wherein, when the high voltage stress test is performed, the charge pump boosts the second analog drive voltage output by the regulator to output the gate on voltage.

9. The liquid crystal display of claim 1, wherein, the charge pump comprises a first transistor outputting the input voltage in response to a high voltage stress test signal during the high voltage stress test and a second transistor outputting the analog driver voltage in response to the high voltage stress test signal during the normal operation.

10. A DC-DC converter comprising:

a pulse width modulation circuit which modulates a pulse width of an analog drive voltage and a gate-on voltage;

a boost converter which boosts an input voltage to output the analog drive voltage; and a charge pump which boosts one of the input voltage and the analog drive voltage to output the gate on voltage, wherein, when a high voltage stress test is performed, the analog drive voltage is boosted to a voltage level higher than a voltage level of the analog drive voltage during a normal operation, and the gate-on voltage maintains a voltage level equal to a voltage level of the gate-on voltage during the normal operation.

11. The DC-DC converter of claim 10, wherein, when the normal operation is performed, the charge pump boosts the analog drive voltage to output the gate on voltage.

12. The DC-DC converter of claim 10, wherein, when the high voltage stress test is performed, the charge pump boosts the input voltage, which has a lower voltage level than the analog drive voltage, to output the gate on voltage.

13. The DC-DC converter of claim 10, further comprising a regulator which outputs a second analog drive voltage having a preset voltage level during the high voltage stress test.

14. The DC-DC converter of claim 13, wherein the second analog drive voltage output by the regulator has a lower voltage level than the analog drive voltage during the high voltage stress test.

15. The DC-DC converter of claim 13, wherein, when the high voltage stress test is performed, the charge pump boosts the second analog drive voltage output by the regulator to output the gate on voltage.

16. The DC-DC converter of claim 10, wherein, the charge pump comprises a first transistor outputting the input voltage in response to a high voltage stress test signal during the high voltage stress test and a second transistor outputting the analog driver voltage in response to the high voltage stress test signal during the normal operation.

17. A method of operating a liquid crystal display, the method comprising:

generating an analog drive voltage and a gate-on voltage using an input voltage; and operating a liquid crystal panel using the analog driver voltage and the gate-on voltage, wherein the generating the analog drive voltage and the gate-on voltage comprises:

modulating a pulse width of the analog drive voltage and the gate-on voltage using a pulse width modulation circuit;

outputting the analog drive voltage by boosting the input voltage through a boost converter; and outputting the gate-on voltage by boosting one of the input voltage and the analog drive voltage through a charge pump, wherein, when a high voltage stress test is performed, the analog drive voltage is boosted to a voltage level higher than a voltage level of the analog drive voltage during a normal operation, and the gate-on voltage has a voltage level equal to a voltage level of the gate-on voltage during the normal operation.

18. The method of claim 17, wherein, when the high voltage stress test is performed, an input voltage, having a voltage level lower than the analog drive voltage during the normal operation, is boosted to generate the gate-on voltage.

19. The method of claim 17, wherein, when the high voltage stress test is performed, the analog drive voltage during the high voltage stress test has a voltage level higher than the analog drive voltage during the normal operation.

20. The method of claim 17, wherein, when the high voltage stress test is performed, a second analog drive voltage during the high voltage stress test, having a voltage level lower than the analog drive voltage during the high voltage stress test, is boosted to generate the gate-on voltage.

21. The method of claim 17, wherein, the charge pump comprises a first transistor outputting the input voltage in response to a high voltage stress test signal during the high voltage stress test and a second transistor outputting the analog driver voltage in response to the high voltage stress test signal during the normal operation.

* * * * *